US011348521B2

(12) United States Patent
Cho et al.

(10) Patent No.: US 11,348,521 B2
(45) Date of Patent: May 31, 2022

(54) DISPLAY DEVICE AND DRIVING METHOD THEREOF

(71) Applicant: Samsung Display Co., Ltd., Yongin-si (KR)

(72) Inventors: Young Jin Cho, Seoul (KR); Ji Su Na, Yongin-si (KR); Yang Wan Kim, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/124,356

(22) Filed: Dec. 16, 2020

(65) Prior Publication Data

US 2021/0225282 A1 Jul. 22, 2021

(30) Foreign Application Priority Data

Jan. 22, 2020 (KR) ..... 10-2020-0008723

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01);
(Continued)

(58) Field of Classification Search
CPC .. G09G 3/3233; G09G 3/3266; G09G 3/3291; G09G 2300/0426;
(Continued)

(56) References Cited

U.S. PATENT DOCUMENTS

2011/0157125 A1* 6/2011 Choi ..... G09G 3/3233 345/211
2011/0279433 A1* 11/2011 Ryu ..... G09G 3/3291 345/211
(Continued)

FOREIGN PATENT DOCUMENTS

CN 109872673 A 6/2019
CN 110178174 A 8/2019
(Continued)

*Primary Examiner* — Mihir K Rayan
(74) *Attorney, Agent, or Firm* — Lewis Roca Rothgerber Christie LLP

(57) ABSTRACT

A display device includes a plurality of pixels. A pixel includes an organic light emitting diode and a pixel circuit including a first transistor that includes a gate electrode connected with a first node, a first electrode connected with a second node, and a second electrode connected with a third node; a second transistor that includes a gate electrode connected with a first gate line, a first electrode connected with a data line, and a second electrode connected with the second node; a third transistor that includes a gate electrode connected with a third gate line, a first electrode connected with the third node, and a second electrode connected with the first node; and a fourth transistor that includes a gate electrode connected with a second gate line, a first electrode connected with the third gate line, and a second electrode connected with the first node.

20 Claims, 12 Drawing Sheets

(52) U.S. Cl.
CPC ..... *G09G 2300/0426* (2013.01); *G09G 2300/0809* (2013.01); *G09G 2330/028* (2013.01)

(58) Field of Classification Search
CPC ... G09G 2300/0809; G09G 2300/0819; G09G 2300/0842; G09G 2300/0861; G09G 2300/0439; G09G 2300/0469; G09G 2330/028; G09G 2310/0245
See application file for complete search history.

(56) References Cited

U.S. PATENT DOCUMENTS

| | | | | |
|---|---|---|---|---|
| 2017/0103701 | A1* | 4/2017 | Zhu ..... | G09G 3/3233 |
| 2017/0162114 | A1* | 6/2017 | Ono ..... | G09G 3/3233 |
| 2017/0365218 | A1* | 12/2017 | Jeong ..... | G09G 3/3225 |
| 2019/0096337 | A1* | 3/2019 | Zhu ..... | G09G 3/3233 |
| 2020/0410932 | A1* | 12/2020 | Kobayashi ..... | G09G 3/3266 |

FOREIGN PATENT DOCUMENTS

| | | | |
|---|---|---|---|
| KR | 10-2015-0124922 | A | 11/2015 |
| KR | 10-2019-0098315 | A | 8/2019 |

* cited by examiner

DISPLAY DEVICE AND DRIVING METHOD THEREOF

CROSS-REFERENCE TO RELATED APPLICATION

This application claims priority to, and the benefit of, Korean Patent Application No. 10-2020-0008723 filed in the Korean Intellectual Property Office on Jan. 22, 2020, the entire content of which is incorporated herein by reference.

BACKGROUND

1. Field

Some embodiments of the present disclosure relate to a display device and a driving method thereof. For example, the present disclosure relates to a display device including an organic light emitting diode (OLED), and a driving method thereof.

2. Description of the Related Art

Recently, an organic light emitting diode (OLED) display has attracted attention. The organic light emitting diode display displays an image by using an organic light emitting diode that generates light by recombination of electrons and holes. The organic light emitting diode display has a self-luminous characteristic, and because it does not need a separate light source, unlike a liquid crystal display, it can have a relatively small thickness and weight. For example, the organic light emitting diode display exhibits high-quality characteristics such as low power consumption, high luminance, high response speed, etc.

A plurality of power voltages may be supplied to a plurality of pixels for light emission of organic light emitting diodes included in the plurality of pixels. For example, a first power voltage for supplying a current to an anode of the organic light emitting diode and a second power voltage supplied to a cathode of the organic light emitting diode are supplied to the plurality of pixels. For example, at least one voltage may be supplied to a plurality of pixels depending on the structure of the plurality of pixels. In order to supply a voltage to a plurality of pixels, a number of power lines corresponding to the type of voltage may be designed. As the number of power lines that may be connected with each pixel increases, the space required to form the pixel may increase. This may be a constraint on the design of high resolution display devices that may require to form more pixels in a limited space.

The above information disclosed in this Background section is only for enhancement of understanding of the background of the disclosure and therefore it may contain information that does not form the prior art that is already known in this country to a person of ordinary skill in the art.

SUMMARY

Some embodiments of the present disclosure provide a display device that can reduce the number of power lines that are connected with each pixel, and a driving method thereof.

A display device according to some embodiments of the present disclosure includes a plurality of pixels, a pixel of the plurality of pixels includes an organic light emitting diode and a pixel circuit to control a current flowing to the organic light emitting diode, wherein the pixel circuit includes a first transistor that includes a gate electrode connected with a first node, a first electrode connected with a second node, and a second electrode connected with a third node; a second transistor that includes a gate electrode connected with a first gate line, a first electrode connected with a data line, and a second electrode connected with the second node; a third transistor that includes a gate electrode connected with a third gate line, a first electrode connected with the third node, and a second electrode connected with the first node; and a fourth transistor that includes a gate electrode connected with a second gate line, a first electrode connected with the third gate line, and a second electrode connected with the first node.

In one or more embodiments, the fourth transistor may transmit a third gate signal of a gate-off voltage applied to the third gate line to the first node and initialize a gate voltage of the first transistor.

In one or more embodiments, the first transistor and the second transistor may be polycrystalline transistors including a polycrystalline semiconductor, and the third transistor and the fourth transistor may be oxide transistors including an oxide semiconductor.

In one or more embodiments, the first transistor and the second transistor may be p-type transistors to be turned on by a low level voltage, and, the third transistor and the fourth transistor may be n-type transistors to be turned on by a high level voltage.

In one or more embodiments, the pixel circuit may further include: a fifth transistor that includes a gate electrode connected with a light emission control line, a first electrode connected with a power line to which a first power voltage is applied, and a second electrode connected with the second node; a sixth transistor that includes a gate electrode connected with the light emission control line, a first electrode connected with the third node, and a second electrode connected with a fourth node; and a seventh transistor that includes a gate electrode connected with a fourth gate line, a first electrode connected with a power line to which an initialization voltage is applied, and a second electrode connected with the fourth node, wherein an anode of the organic light emitting diode may be connected with the fourth node.

In one or more embodiments, the pixel circuit may further include an eighth transistor that includes a gate electrode connected with the fourth gate line, a first electrode connected with a power line to which a reference voltage is applied, and a second electrode connected with the second node.

In one or more embodiments, the reference voltage may be higher than the first power voltage.

In one or more embodiments, the pixel circuit may further include an eighth transistor that includes a gate electrode connected with the fourth gate line, a first electrode connected with the power line to which the first power voltage is applied, and a second electrode connected with the second node.

In one or more embodiments, the pixel circuit may further include an eighth transistor that includes a gate electrode connected with the fourth gate line, a first electrode connected with the light emission control line, and a second electrode connected with the second node.

In one or more embodiments, the pixel circuit may further include: a fifth transistor that includes a gate electrode connected with a light emission control line, a first electrode connected with a power line to which a first power voltage is applied, and a second electrode connected with the second node; a sixth transistor that includes a gate electrode connected with the light emission control line, a first electrode connected with the third node, and a second electrode connected with a fourth node; and a seventh transistor that includes a gate electrode connected with a fourth gate line, a first electrode connected with the third gate line, and a second electrode connected with the fourth node, wherein an anode of the organic light emitting diode is connected with the fourth node.

In one or more embodiments, the pixel circuit may further include an eighth transistor that includes a gate electrode connected with the fourth gate line, a first electrode connected with a power line to which a reference voltage is applied, and a second electrode connected with the second node.

In one or more embodiments, the pixel circuit may further include an eighth transistor that includes a gate electrode connected with the fourth gate line, a first electrode connected with the power line to which the first power voltage is applied, and a second electrode connected with the second node.

In one or more embodiments, the pixel circuit may further include an eighth transistor that includes a gate electrode connected with the fourth gate line, a first electrode connected with the light emission control line, and a second electrode connected with the second node.

A display device according to some embodiments of the present disclosure includes a plurality of pixels, a pixel of the plurality of pixels includes an organic light emitting diode and a pixel circuit to control a current flowing to the organic light emitting diode, wherein the pixel circuit includes a first transistor that includes a gate electrode connected with a first node, a first electrode connected with a second node, and a second electrode connected with a third node; a second transistor that includes a gate electrode connected with a first gate line, a first electrode connected with a data line, and a second electrode connected with the second node; a third transistor that includes a gate electrode connected with a third gate line, a first electrode connected with the third node, and a second electrode connected with the first node; a fourth transistor that includes a gate electrode connected with a second gate line, a first electrode connected with a power line to which an initialization voltage is applied, and a second electrode connected with the first node; and a fourth transistor that includes a gate electrode connected with a second gate line, a first electrode connected with a power line to which an initialization voltage is applied, and a second electrode connected with the first node, wherein an anode of the organic light emitting diode is connected with the fourth node.

In one or more embodiments, the seventh transistor may transmit a third gate signal of a gate-off voltage applied to the third gate line to the fourth node, and resets an anode voltage of the organic light emitting diode.

In one or more embodiments, the pixel circuit may further include an eighth transistor that includes a gate electrode connected with the fourth gate line, a first electrode connected with a power line to which a reference voltage is applied, and a second electrode connected with the second node.

In one or more embodiments, the pixel circuit may further include an eighth transistor that includes a gate electrode connected with the fourth gate line, a first electrode connected with a power line to which a first power voltage is applied, and a second electrode connected with the second node.

In one or more embodiments, the pixel circuit may further include: a fifth transistor that includes a gate electrode connected with a light emission control line, a first electrode connected with a power line to which a first power voltage is applied, and a second electrode connected with the second node; a sixth transistor that includes a gate electrode connected with the light emission control line, a first electrode connected with the third node, and a second electrode connected with the fourth node; and an eighth transistor that includes a gate electrode connected with the fourth gate line, a first electrode connected with the light emission control line, and a second electrode connected with the second node.

According to some embodiments of the present disclosure, a method for driving a display device that includes a plurality of pixels, a pixel of the plurality of pixels includes a pixel circuit to receive a first gate signal, a second gate signal, a third gate signal, a fourth gate signal, and a light emission signal, and to control a current flowing to an organic light emitting diode, is provided. The method includes: resetting an anode voltage of the organic light emitting diode as the fourth gate signal is applied as a gate-on voltage, and resetting a first transistor that controls a current flowing to the organic light emitting diode from a first power voltage; initializing a gate voltage of the first transistor to a gate-off voltage of the third gate signal as the second gate signal is applied as a gate-on voltage; diode-coupling the first transistor as the first gate signal and the third gate signal are applied as a gate-on voltage and writing a data voltage compensated from a threshold voltage of the first transistor as a gate voltage of the first transistor; and emitting light with brightness corresponding to a current flowing through the first transistor by the organic light emitting diode as the light emission signal is applied as a gate-on voltage.

In one or more embodiments, the first transistor may be reset to one of the first power voltage, a reference voltage that is higher than the first power voltage, or a high level voltage of the light emission signal as the fourth gate signal is applied as a gate-on voltage.

Because the pixel is configured not to require at least one of the first initialization voltage, the second initialization voltage, and the reference voltage, the number of power lines disposed on the display portion may be reduced, and the number of converters included in the power supply may be reduced as well.

BRIEF DESCRIPTION OF THE DRAWINGS

These and other features of some embodiments of the present disclosure will be appreciated and understood with reference to the specification, claims, and appended drawings, wherein:

DETAILED DESCRIPTION

Figure 1:
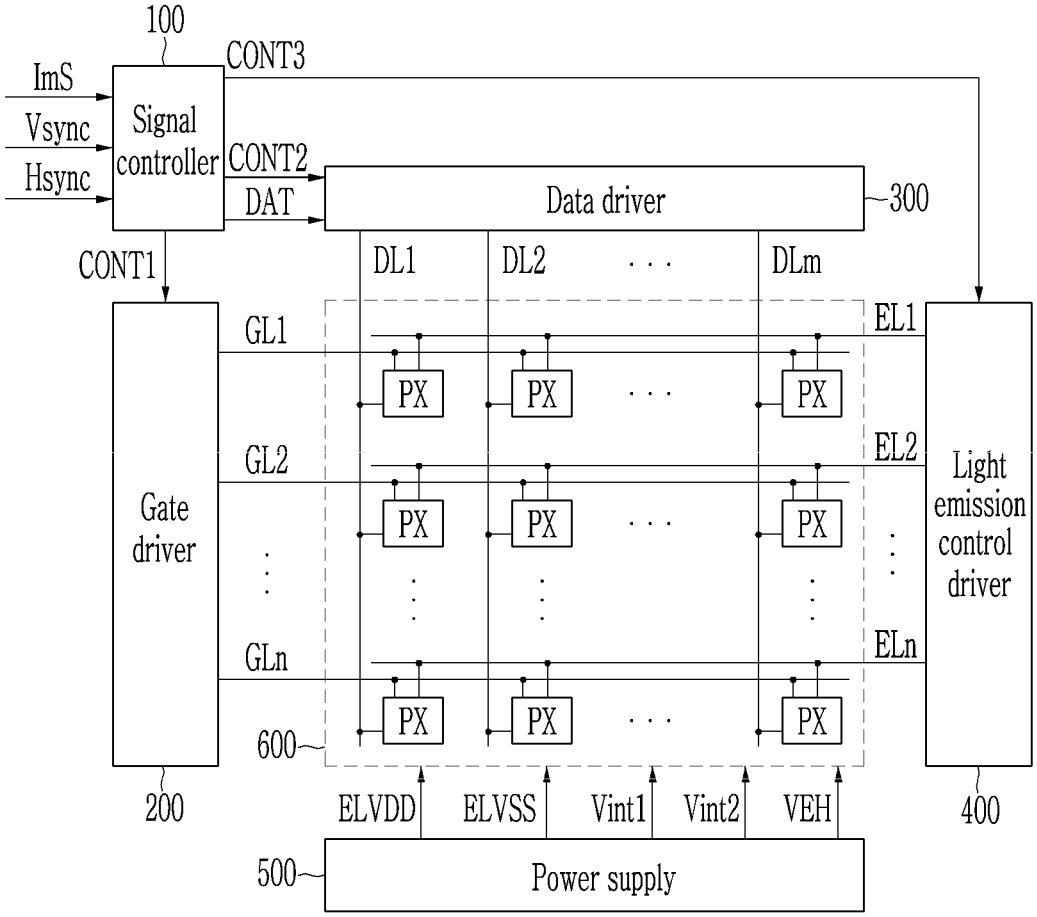
FIG. 1 is a block diagram of a display device according to one or more embodiments of the present disclosure.

Some embodiments of the present disclosure will be described more fully hereinafter with reference to the accompanying drawings, in which embodiments of the disclosure are shown. As those skilled in the art would realize, the described embodiments may be modified in various different ways, all without departing from the spirit or scope of the present disclosure.

Further, in the described embodiments, because like reference numerals designate like elements having the same configuration, a first embodiment is representatively described, and in other embodiments, only different configurations from the first embodiment will be described.

Accordingly, the drawings and description are to be regarded as illustrative in nature and not restrictive. Like reference numerals designate like elements throughout the specification.

In addition, unless explicitly described to the contrary, the word "comprise" and variations such as "comprises" or "comprising" will be understood to imply the inclusion of stated elements but not the exclusion of any other elements.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present invention". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

FIG. 1 is a block diagram of a display device according to one or more embodiments of the present disclosure.

Referring to FIG. 1, a display device includes a signal controller 100, a gate driver 200, a data driver 300, a light emission control driver 400, a power supply 500, and a display portion 600.

In one or more embodiments, the signal controller 100 receives an image signal ImS and an input control signal from the outside. The image signal ImS contains luminance information of each pixel PX. Luminance corresponds to a number of gray levels (e.g., a predetermined or set number of gray levels). The input control signal may include a vertical synchronization signal Vsync and a horizontal synchronization signal Hsync. The signal controller 100 may divide the image signal ImS into frame units according to the vertical synchronization signal Vsync. The signal controller 100 may divide the image signal ImS into gate line (GL1 to GLn) units or pixel row units according to the horizontal synchronization signal Hsync. The signal controller 100 processes the image signal ImS in accordance with operation conditions of the display portion 600 and the data driver 300 based on the image signal ImS and the input control signal, and may generate an image data signal DAT, a gate control signal CONT1, a data control signal CONT2, and a light emission control signal CONT3. The gate control signal CONT1 may include a signal that instructs the start of output of a gate signal. The data control signal CONT2 may include a signal that instructs the start of output of a data voltage. The light emission control signal CONT3 may include a signal that instructs the start of output of a light emission signal. The signal controller 100 transmits the gate control signal CONT1 to the gate driver 200. The signal controller 100 transmits the data control signal CONT2 and the image data signal DAT to the data driver 300. The signal controller 100 transmits the light emission control signal CONT3 to the light emission control driver 400.

The display portion 600 includes a plurality of gate lines GL1 to GLn, a plurality of data lines DL1 to DLm, a plurality of light emission control lines EL1 to ELn, and a plurality of pixels PX. The plurality of pixels PX are connected to the plurality of gate lines GL1 to GLn, the plurality of data lines DL1 to DLm, and the plurality of light emission control lines EL1 to ELn, and may be arranged approximately in a matrix format. The plurality of gate lines GL1 to GLn extend approximately along a row direction, and thus they may be almost parallel with each other. The plurality of light emission control lines EL1 to ELn extend approximately along a row direction as well, and thus they may be almost parallel with each other. The plurality of data lines DL1 to DLm extend approximately along a column direction, and thus they may be almost parallel with each other. In FIG. 1, it is illustrated that one of the gate lines GL1 to GLn extends for each pixel for simplification of the drawing, but each gate line for each pixel row may include a plurality of gate lines (e.g., GLn1, GLn2, GLn3, and GLn4 in FIG. 2).

The gate driver 200 is connected with the plurality of gate lines GL1 to GLn. The gate driver 200 applies a gate signal formed of a combination of a gate-on voltage and a gate-off voltage according to the gate control signal CONT1 to the plurality of gate lines GL1 to GLn. The gate driver 200 may sequentially apply a gate signal of a gate-on voltage to the plurality of gate lines GL1 to GLn. The gate driver 200 applies the gate signal of the gate-on voltage to a plurality of gate lines GLn1, GLn2, GLn3, and GLn4 included in the respective gate lines GL1 to GLn at proper timing such that reset, initialization, data writing, and light emission operations of the pixel PX can be carried out. This will be described later with reference to FIG. 2 and FIG. 3.

The data driver 300 is connected with a plurality of data lines DL1 to DLm. The data driver 300 samples and holds the image data signal DAT according to the data control signal CONT2, and applies a data voltage corresponding to the image data signal DAT to the plurality of data lines DL1 to DLm. The data driver 300 may apply a data voltage having a voltage range (e.g., a predetermined or set voltage range) to the plurality of data lines DL1 to DLm corresponding to the gate signal of the gate-on voltage. The data driver 300 may apply a data voltage to the plurality of data lines DL1 to DLm in accordance with a data writing period (e.g., data writing period P3 of FIG. 3) of the pixel PX.

The light emission control driver 400 is connected with a plurality of light emission control lines EL1 to ELn. The light emission control driver 400 may apply a light emission signal formed of a combination of the gate-on voltage and the gate-off voltage to the plurality of light emission control lines EL1 to ELn according to the light emission control signal CONT3. The light emission control driver 400 may sequentially apply the light emission control signal CONT3 of the gate-on voltage to the plurality of light emission control lines EL1 to ELn.

The power supply 500 may generate a first power voltage ELVDD, a second power voltage ELVSS, a first initialization voltage Vint1, a second initialization voltage Vint2, and a reference voltage VEH. The power supply 500 may include a plurality of converters for generation of the first power voltage ELVDD, the second power voltage ELVSS, the first initialization voltage Vint1, the second initialization voltage Vint2, and the reference voltage VEH. The power supply 500 may supply the first power voltage ELVDD, the second power voltage ELVSS, the first initialization voltage Vint1, the second initialization voltage Vint2, and the reference voltage VEH to the display portion 600. The first power voltage ELVDD is a high level voltage, and the second power voltage ELVSS is a low level voltage. The first initialization voltage Vint1 and the second initialization voltage Vint2 may be low-level voltages that are the same as or lower than the second power voltage ELVSS. The first initialization voltage Vint1 and the second initialization voltage Vint2 may be different levels of voltages. The reference voltage VEH may be a high level voltage that is higher than the first power voltage ELVDD. For example, the first power voltage ELVDD may be about 4 V to about 4.5 V, the second power voltage ELVSS may be about −4.5 V to about −4.0 V, the first initialization voltage Vint1 and the second initialization voltage Vint2 may be about −5.0V to about −4.5 V, and the reference voltage VEH may be about 6 V or more. The first power voltage ELVDD, the second power voltage ELVSS, the first initialization voltage Vint1, the second initialization voltage Vint2, and the reference voltage VEH do not have a limitation in voltage level.

Although it is not illustrated in FIG. 1, the first power voltage ELVDD may be applied to the plurality of pixels PX through a plurality of power lines extending substantially along a column direction in the display portion 600. The second power voltage ELVSS may be formed throughout the entire surface of the display portion 600. The first initialization voltage Vint1 may be applied to the plurality of pixels PX through a plurality of power lines extending substantially along a row direction in the display portion 600. The second initialization voltage Vint2 may be applied to the plurality of pixels PX through a plurality of power lines extending substantially along the row direction in the display portion 600. The reference voltage VEH may be applied to the plurality of pixels PX through a plurality of power lines extending substantially along the row direction in the display portion 600.

Depending on a structure of the pixel PX, at least one of the first initialization voltage Vint1, the second initialization voltage Vint2, and the reference voltage VEH may be omitted. For example, depending on a structure of the pixel PX, at least one of the power line for application of the first initialization voltage Vint1, the power line for application of the second initialization voltage Vint2, and the power line for application of the reference voltage VEH may be omitted. As the number of power lines arranged in the display portion 600 is reduced, a space required for forming the pixel PX may be reduced. Accordingly, a high-resolution display device may be more effectively manufactured.

Hereinafter, a pixel PX according to one or more embodiments of the present disclosure, which may reduce the number of power lines, will be described. First, referring to FIG. 2, a pixel PX according to one or more embodiments will be described, and referring to FIG. 3, a method for driving a display device that includes the pixel PX according to one or more embodiments will be described.

Figure 2:
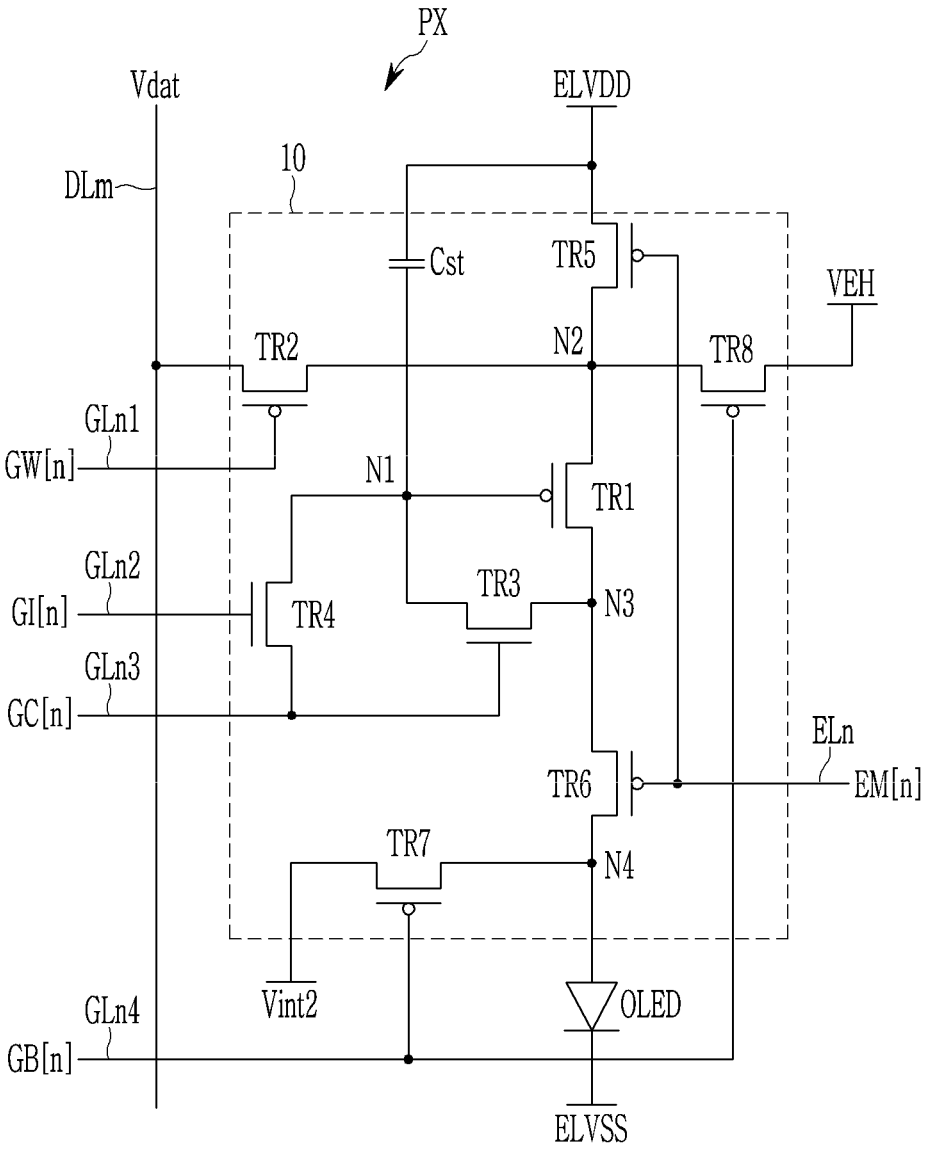
FIG. 2 is a circuit diagram of a pixel circuit according to one or more embodiments of the present disclosure.

FIG. 2 is a circuit diagram of a pixel circuit according to one or more embodiments of the present disclosure. A pixel PX located in an n-th pixel row and an m-th pixel column from among the plurality of pixels PX included in the display device of FIG. 1 will be described.

Referring to FIG. 2, a pixel PX includes an organic light emitting diode OLED and a pixel circuit 10. The pixel circuit 10 controls a current flowing to the organic light emitting diode OLED from the first power voltage ELVDD.

The pixel circuit 10 includes a plurality of transistors TR1, TR2, TR3, TR4, TR5, TR6, TR7, and TR8 and a sustain capacitor Cst.

The first transistor TR1 includes a gate electrode connected with a first node N1, a first electrode connected with a second node N2, and a second electrode connected with a third node N3. The first transistor TR1 is connected between the first power voltage ELVDD and the organic light emitting diode OLED, and controls a current flowing to the organic light emitting diode OLED from the first power voltage ELVDD corresponding to a voltage of the first node N1.

The second transistor TR2 includes a gate electrode connected with the first gate line GLn1, a first electrode connected with the data line DLm, and a second electrode connected with the second node N2. The second transistor TR2 is connected between the data line DLm and the first transistor TR1, and is turned on according to a first gate signal GW[n] applied to a first gate line GLn1 and transmits a data voltage Vdat applied to the data line DLm to the second node N2.

The third transistor TR3 includes a gate electrode connected with a third gate line GLn3, a first electrode connected with the third node N3, and a second electrode connected with the first node N1. The third transistor TR3 is connected between the second electrode and the gate electrode of the first transistor TR1, and is turned on according to a third gate signal GC[n] of a gate-on voltage applied to the third gate line GLn3. The third transistor TR3 may compensate a threshold voltage of the first transistor TR1 by diode-coupling the first transistor TR1. A data voltage, which is compensated from the threshold voltage of the first transistor TR1, is transmitted to the first node N1.

The fourth transistor TR4 includes a gate electrode connected with the second gate line GLn2, a first electrode connected with the third gate line GLn3, and a second electrode connected with the first node N1. The fourth transistor TR4 is turned on by a second gate signal GI[n] of a gate-on voltage applied to the second gate line GLn2. The fourth transistor TR4 transmits a third gate signal GC[n] of a low level voltage (e.g., the gate-off voltage) applied to the third gate line GLn3 to the first node N1 to initialize a gate voltage of the first transistor TR1 to the low level voltage (e.g., gate-off voltage) of the third gate signal GC[n].

The fifth transistor TR5 includes a gate electrode connected with the light emission control line ELn, a first electrode connected with a power line to which the first power voltage ELVDD is applied, and a second electrode connected with the second node N2. The fifth transistor TR5 is connected between the power line to which the first power voltage ELVDD is applied and the first transistor TR1. The fifth transistor TR5 is turned on according to a light emission signal EM[n] of a gate-on voltage applied to the light emission control line ELn and transmits the first power voltage ELVDD to the first electrode of the first transistor TR1.

The sixth transistor TR6 includes a gate electrode connected with the light emission control line ELn, a first electrode connected with the third node N3, and a second electrode connected with a fourth node N4. The fourth node N4 is connected with an anode of the organic light emitting diode OLED. The sixth transistor TR6 is connected between the first transistor TR1 and the organic light emitting diode OLED. The sixth transistor TR6 is turned on according to the light emitting signal EM[n] of the gate-on voltage applied to the light emission control line ELn, and transmits a current flowing through the first transistor TR1 to the organic light emitting diode OLED.

The seventh transistor TR7 includes a gate electrode connected with the fourth gate line GLn4, a first electrode connected with a power line to which the second initialization voltage Vint2 is applied, and a second electrode connected with the fourth node N4. The seventh transistor TR7 is connected between the power line to which the second initialization voltage Vint2 is applied and the anode of the organic light emitting diode OLED. The seventh transistor TR7 is turned on by a fourth gate signal GB[n] of a gate-on voltage applied to the fourth gate line GLn4. The seventh transistor TR7 transmits the second initialization voltage Vint2 to the anode of the organic light emitting diode OLED to reset the anode of the organic light emitting diode OLED with the second initialization voltage Vint2.

The eighth transistor TR8 includes a gate electrode connected with the fourth gate line GLn4, a first electrode connected with a power line to which the reference voltage VEH is applied, and a second electrode connected with the second node N2. The eighth transistor TR8 is connected between the power line to which the reference voltage VEH is applied and the second node N2. The eighth transistor TR8 is turned on by the fourth gate signal GB[n] of the gate-on voltage applied to the fourth gate line GLn4. The eighth transistor TR8 transmits the reference voltage VEH to the second node N2 to reset a voltage of the second node N2 to the reference voltage VEH.

Some transistors (e.g., third and fourth transistors TR3 and TR4) of the plurality of transistors TR1, TR2, TR3, TR4, TR5, TR6, TR7, and TR8 may be oxide transistors that include semiconductor layers formed of a semiconductor oxide. The oxide transistor may have a characteristic of an n-type transistor. Other transistors (e.g., first, second, fifth, sixth, seventh, and eighth transistors TR1, TR2, TR5, TR6, TR7, and TR8) from among the plurality of transistors TR1, TR2, TR3, TR4, TR5, TR6, TR7, and TR8 may be polycrystalline transistors including a semiconductor layer formed of a polycrystalline semiconductor. The polycrystalline transistor may have a characteristic of a p-type transistor. However, the embodiments of the present disclosure are not limited thereto.

The oxide transistor may have lower leakage current than polycrystalline transistors. The polycrystalline transistor has a merit that has a characteristic of flowing a driving current due to faster charge transfer than an oxide transistor. In the embodiments of the present disclosure, each of the third transistor TR3, and the fourth transistor TR4 is formed of an oxide transistor, and the remaining transistors TR1, TR2, TR5, TR6, TR7, and TR8 are formed of polycrystalline transistors. However, at least one of the transistors TR2, TR5, TR6, TR7, and TR8 excluding the first transistor TR1 may be formed of an oxide transistor in one or more embodiments.

A gate-on voltage that turns on an n-type transistor is a high level voltage, and a gate-off voltage that turns off the n-type transistor is a low level voltage. A gate-on voltage that turns on a p-type transistor is a low level voltage, and a gate-off voltage that turns off the p-type transistor is a high level voltage.

The sustain capacitor Cst includes a first electrode connected with the power line to which the first power voltage ELVDD is applied and a second electrode connected with the first node N1. A data voltage compensated from the threshold voltage of the driving transistor TR1 is transmitted to the first node N1, and the sustain capacitor Cst serves to maintain a voltage of the first node N1.

The organic light emitting diode OLED includes an anode connected with the fourth node N4 and a cathode to which the second power voltage ELVSS is applied. The organic light emitting diode OLED is connected between the pixel circuit 10 and the second power voltage ELVSS, and thus may emit light with luminance corresponding to a current supplied from the pixel circuit 10. The organic light emitting diode OLED may include an emission layer including an organic light emitting material. The hole and electron are injected into the emission layer from the anode and the cathode, respectively, and an exciton generated by coupling the injected hole and electron falls from an excited state to a ground state to emit light. The organic light emitting diode OLED may emit light of one of primary colors or white light. The primary colors may be, for example, three primary colors of red, green, and blue. In one or more embodiments, the primary colors may include yellow, cyan, and magenta.

Figure 3:
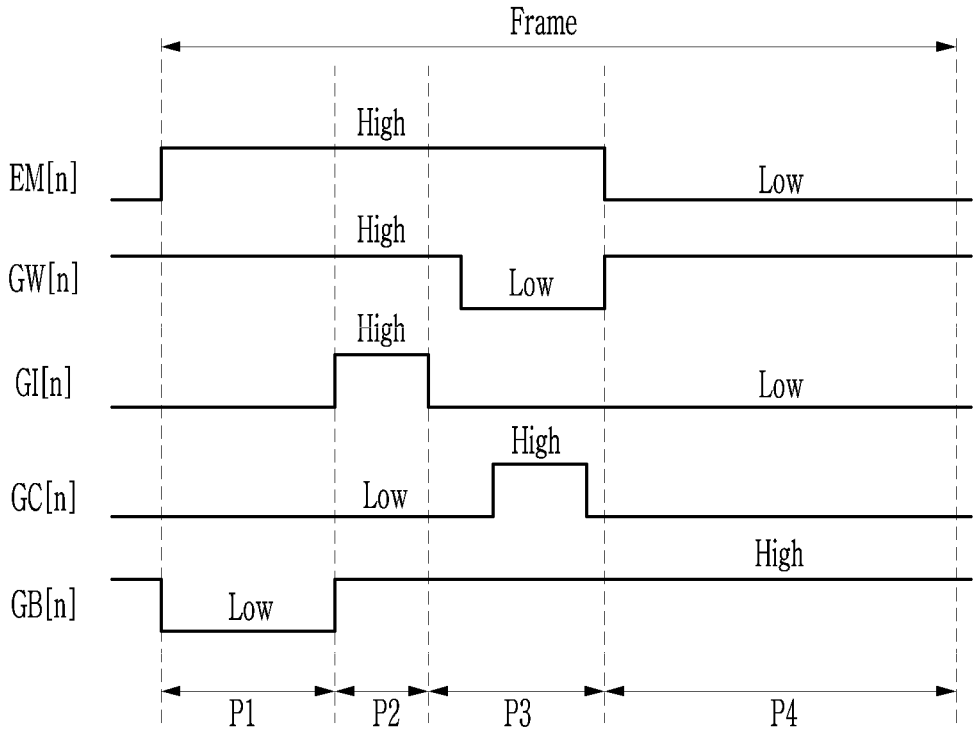
FIG. 3 is a timing diagram of a driving method of a display device according to one or more embodiments of the present disclosure.

FIG. 3 is a timing diagram of a driving method of a display device according to one or more embodiments of the present disclosure. With reference to FIG. 3, a driving method of a display device including the pixel of FIG. 2 will be described.

Referring to FIG. 2 and FIG. 3, one frame includes a reset period P1, an initialization period P2, a data writing period P3, and a light emission period P4.

The reset period P1 may be a period for resetting an anode voltage of the organic light emitting diode OLED and opposite end voltages of the first transistor TR1. During the reset period P1, the light emitting signal EM[n] and the first gate signal GW[n] are applied at a high level voltage, and the second gate signal GI[n], the third gate signal GC[n], and the fourth gate signal GB[n] are applied at a low level voltage.

The seventh transistor TR7 and the eighth transistor TR8 are turned on by the fourth gate signal GB[n] of the low level voltage (e.g., the gate-on voltage). The remaining transistors TR1, TR2, TR3, TR4, TR5, and TR6 are turned off. The second initialization voltage Vint2 is transmitted to the fourth node N4 through the turned-on seventh transistor TR7, and the anode voltage of the organic light emitting diode OLED is reset to the second initialization voltage Vint2. The reference voltage VEH is transmitted to the second node N2 through the turned-on eighth transistor TR8. A voltage of the first node N1 is a data voltage compensated from the threshold voltage of the first transistor TR1 in the previous frame. Because the reference voltage VEH of the high level voltage is applied to the second node N2, the first transistor TR1 is turned on by a gate-source voltage difference of the first transistor TR1. Accordingly, a voltage difference of the first electrode and the second electrode of the first transistor TR1 is reduced, and stress of the first transistor TR1 due to a voltage difference of opposite ends of the first transistor TR1 may be reduced as well. For example, a voltage of the first electrode and a voltage of the second electrode of the first transistor TR1 are reset. In one or more embodiments, because the fifth transistor TR5 and the sixth transistor TR6 are in the turn-off state, the organic light emitting diode OLED does not emit light.

The initialization period P2 may be a period for initialization of the gate voltage of the first transistor TR1. During the initialization period P2, the light emitting signal EM[n], the first gate signal GW[n], the second gate signal GI[n], and the fourth gate signal GB[n] are applied at a high level voltage, and the third gate signal GC[n] is applied at a low level voltage.

The fourth transistor TR4 is turned on by the second gate signal GI[n] of the high level voltage (e.g., the gate-on voltage). The remaining transistors TR1, TR2, TR3, TR5, TR6, TR7, and TR8 are turned off. The low level voltage (e.g., the gate-off voltage) of the third gate signal GC[n] is transmitted to the first node N1 through the turned-on fourth transistor TR4. The voltage of the first node N1 is initialized to the low level voltage. For example, the gate voltage of the first transistor TR1 is initialized to the low level voltage.

The data writing period P3 may be a period for writing the data voltage Vdat in the pixel PX. During the data writing period P3, the light emitting signal EM[n], the third gate signal GC[n], and the fourth gate signal GB[n] are applied at a high level voltage, and the first gate signal GW[n] and the second gate signal GI[n] are applied at a low level voltage.

The second transistor TR2 is turned on by the first gate signal GW[n] of the low level voltage (e.g., the gate-on voltage). The third transistor TR3 is turned on by the third gate signal GC[n] of the high level voltage (e.g., the gate-on voltage). The fourth transistor TR4, the fifth transistor TR5, the sixth transistor TR6, the seventh transistor TR7, and the eighth transistor TR8 are turned off. The data voltage Vdat is applied to the data line DLm by being synchronized with the first gate signal GW[n] of the gate-on voltage. The data voltage Vdat is transmitted to the second node N2 through the turned-on second transistor TR2. The first transistor TR1 is diode-coupled by the turned-on third transistor TR3, and a data voltage compensated from the threshold voltage of the first transistor TR1 is transmitted to the first node N1. The data voltage compensated from the threshold voltage of the first transistor TR1 is stored in the sustain capacitor Cst. For example, the data voltage compensated from the threshold voltage of the first transistor TR1 is written as a gate voltage of the first transistor TR1.

The light emission period P4 may be a period for light emission of a pixel PX in which the data voltage Vdat is written. During the light emission period P4, the first gate signal GW[n] and the fourth gate signal GB[n] are applied at a high level voltage, and the light emitting signal EM[n], the second gate signal GI[n], and the third gate signal GC[n] are applied at a low level voltage.

The fifth transistor TR5 and the sixth transistor TR6 are turned on by the light emitting signal EM[n] of the low level voltage (e.g., the gate-on voltage). The first transistor TR1 maintains a state of being turned on by a voltage (e.g., the voltage of the first node N1) stored in the sustain capacitor Cst. The remaining transistors TR2, TR3, TR4, TR7, and TR8 are turned off. The first source voltage ELVDD is transmitted to the second node N2 through the turned-on fifth transistor TR5. The first transistor TR1 flows an amount of current corresponding to the voltage of the first node N1 to the third node N3. A current flowing through the first transistor TR1 is transmitted to the organic light emitting diode OLED through the turned-on sixth transistor TR6. Subsequently, the light emitting diode OLED emits light with luminance corresponding to the current flowing through the first transistor TR1.

Because the pixel PX according to the embodiment of FIG. 2 does not require the first initialization voltage Vint1, a power line for the first initialization voltage Vint1 may be omitted in the display portion 600. In one or more embodiments, the power supply 500 may not need to generate the first initialization voltage Vint1, and thus a converter for generating the first initialization voltage Vint1 may be omitted in the power supply 500.

Hereinafter, pixels PX of other embodiments in which the number of power lines aligned in a display portion 600 will be described with reference to FIGS. 4-11, and a pixel PX of a comparative example will be described with reference to FIG. 12. A difference in comparison with the pixel PX of FIG. 2 and a driving method of the display device of FIG. 3 will be mainly described.

Figure 4:
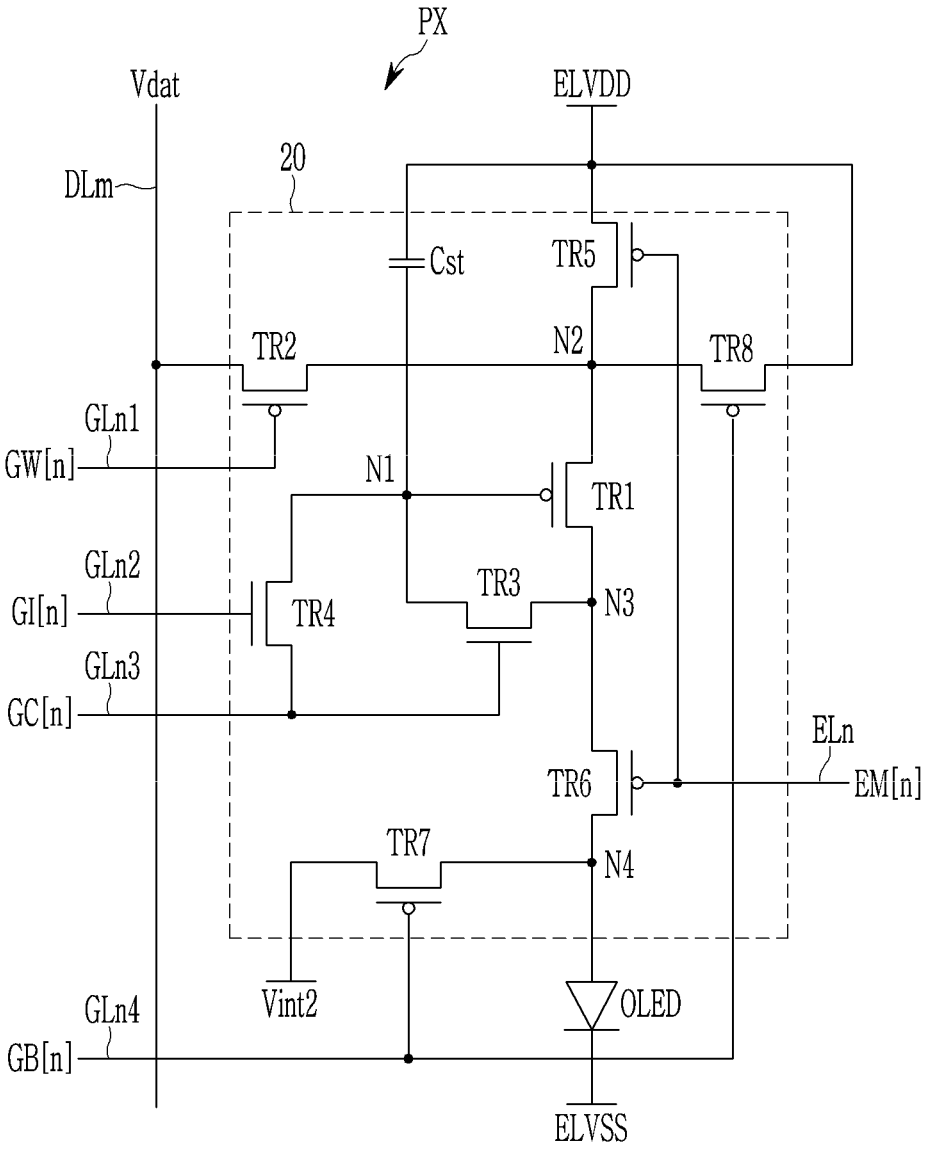
FIG. 4 is a circuit diagram of a pixel circuit according to one or more embodiments of the present disclosure.

FIG. 4 is a circuit diagram of a pixel circuit according to one or more embodiments of the present disclosure.

Referring to FIG. 4, an eighth transistor TR8 included in a pixel circuit 20 according to one or more embodiments includes a gate electrode connected to a fourth gate line GLn4, a first electrode connected to a power line to which a first power voltage ELVDD is applied, and a second electrode connected with a second node N2. The eighth transistor TR8 is connected between the power line to which the first power voltage ELVDD is applied and the second node N2.

The eighth transistor TR8 is turned on by a fourth gate signal GB[n] of a low level voltage (e.g., the gate-on voltage) during a reset period P1, and thus transmits the first power voltage ELVDD to the second node N2.

A pixel PX according to the embodiment of FIG. 4 may not need a first initialization voltage Vint1 and a reference voltage VEH, and thus a power line for the first initialization voltage Vint1 and a power line for the reference voltage VEH may be omitted in a display portion 600, and a converter for generation of the first initialization voltage Vint1 and a converter for generation of the reference voltage VEH may be omitted in a power supply 500.

Except for such a difference, the features of the embodiment described with reference to FIG. 2 and FIG. 3 are applicable to the embodiment described with reference to FIG. 4, and thus the duplicated features of the embodiment described with reference to FIG. 2 and FIG. 3 may not be repeated.

Figure 5:
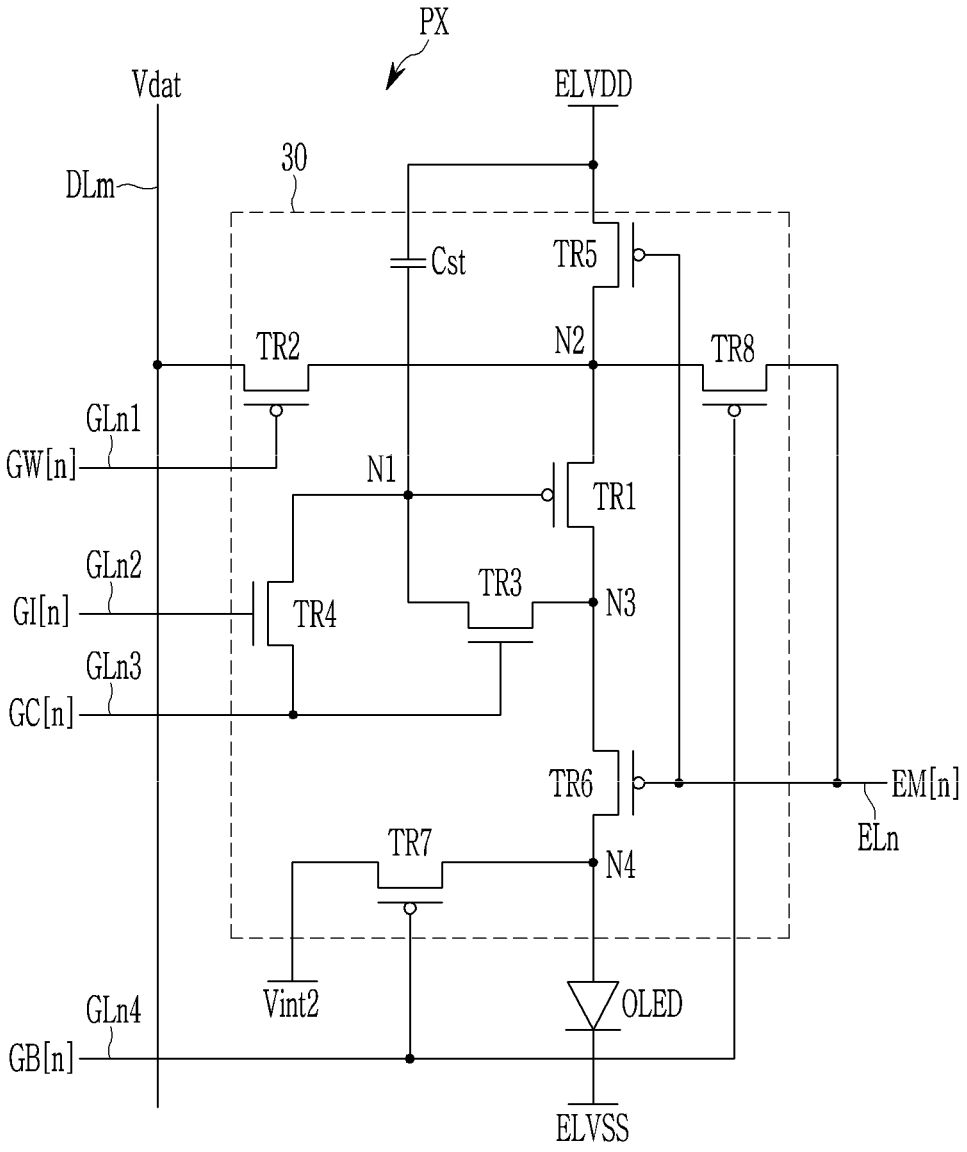
FIG. 5 is a circuit diagram of a pixel circuit according to one or more embodiments of the present disclosure.

FIG. 5 is a circuit diagram of a pixel circuit according to one or more embodiments of the present disclosure.

Referring to FIG. 5, an eighth transistor TR8 included in a pixel circuit 30 according to one or more embodiments includes a gate electrode connected with a fourth gate line GLn4, a first electrode connected with a light emission control line ELn, and a second electrode connected with a second node N2. The eighth transistor TR8 is connected between the light emission control line ELn and the second node N2.

The eighth transistor TR8 is turned on by a fourth gate signal GB[n] of a low level voltage (e.g., the gate-on voltage) during a reset period P1, and thus transmits a light emitting signal EM[n] of a high level voltage to the second node N2.

A pixel PX according to the embodiment of FIG. 5 may not need a first initialization voltage Vint1 and a reference voltage VEH, and thus a power line for the first initialization voltage Vint1 and a power line for the reference voltage VEH may be omitted in a display portion 600, and a converter for generation of the first initialization voltage Vint1 and a converter for generation of the reference voltage VEH may be omitted in a power supply 500.

Except for such a difference, the features of the embodiment described with reference to FIG. 2 and FIG. 3 are applicable to the embodiment described with reference to FIG. 5, and thus the duplicated features of the embodiment described with reference to FIG. 2 and FIG. 3 may not be repeated.

Figure 6:
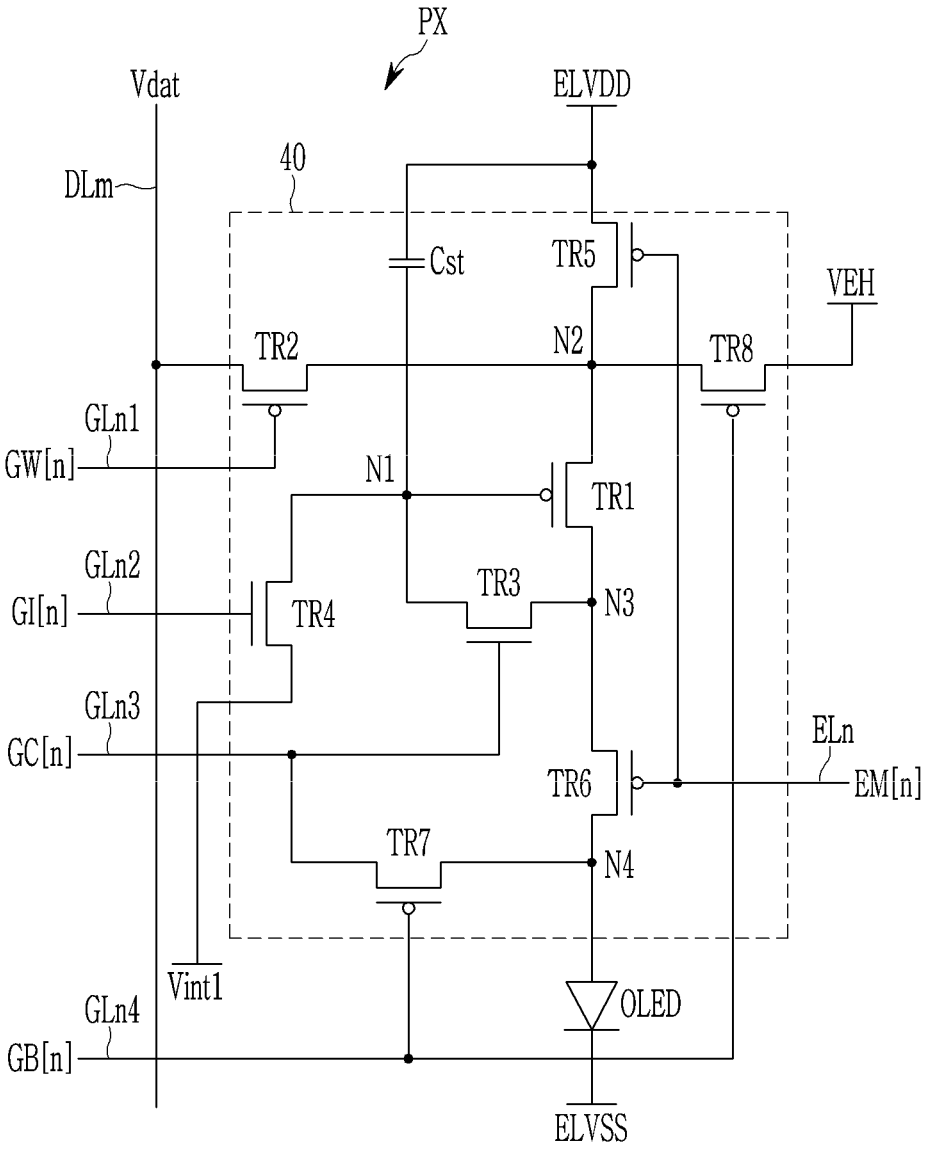
FIG. 6 is a circuit diagram of a pixel circuit according to one or more embodiments of the present disclosure.

FIG. 6 is a circuit diagram of a pixel circuit according to one or more embodiments of the present disclosure.

Referring to FIG. 6, a fourth transistor TR4 included in a pixel circuit 40 according to one or more embodiments includes a gate electrode connected with a second gate line GLn2, a first electrode connected with a power line to which a first initialization voltage Vint1 is applied, and a second electrode connected with a first node N1. The fourth transistor TR4 is connected between the power line to which the first initialization voltage Vint1 is applied and the first node N1.

The fourth transistor TR4 is turned on by a second gate signal GI[n] of a high level voltage (i.e., the gate-on voltage) during an initialization period P2, and thus transmits the first initialization voltage Vint1 to the first node N1. A gate voltage of the first transistor TR1 is initialized to the first initialization voltage Vint1.

A seventh transistor TR7 included in the pixel circuit 40 according to the present embodiment includes a gate electrode connected with a fourth gate line GLn4, a first electrode connected with a third gate line GLn3, and a second electrode connected with a fourth node N4. The seventh transistor TR7 is connected between the third gate line GLn3 and an anode of the organic light emitting diode OLED.

The seventh transistor TR7 is turned on by a fourth gate signal GB[n] of a low level voltage (e.g., the gate-on voltage) during a reset period P1, and thus transmits a third gate signal GC[n] of a low level voltage (e.g., the gate-off voltage) to the fourth node N4. An anode voltage of the organic light emitting diode OLED is reset to the low level voltage of the third gate signal GC[n].

A pixel PX according to the embodiment of FIG. 6 may not need a second initialization voltage Vint2, and thus a power line for generation of the second initialization voltage Vint2 may be omitted in a display portion 600 and a converter for generation of the second initialization voltage Vint2 may be omitted in a power supply 500.

Except for such a difference, the features of the embodiment described with reference to FIG. 2 and FIG. 3 are applicable to the embodiment described with reference to FIG. 6, and thus the duplicated features of the embodiment described with reference to FIG. 2 and FIG. 3 may not be repeated.

Figure 7:
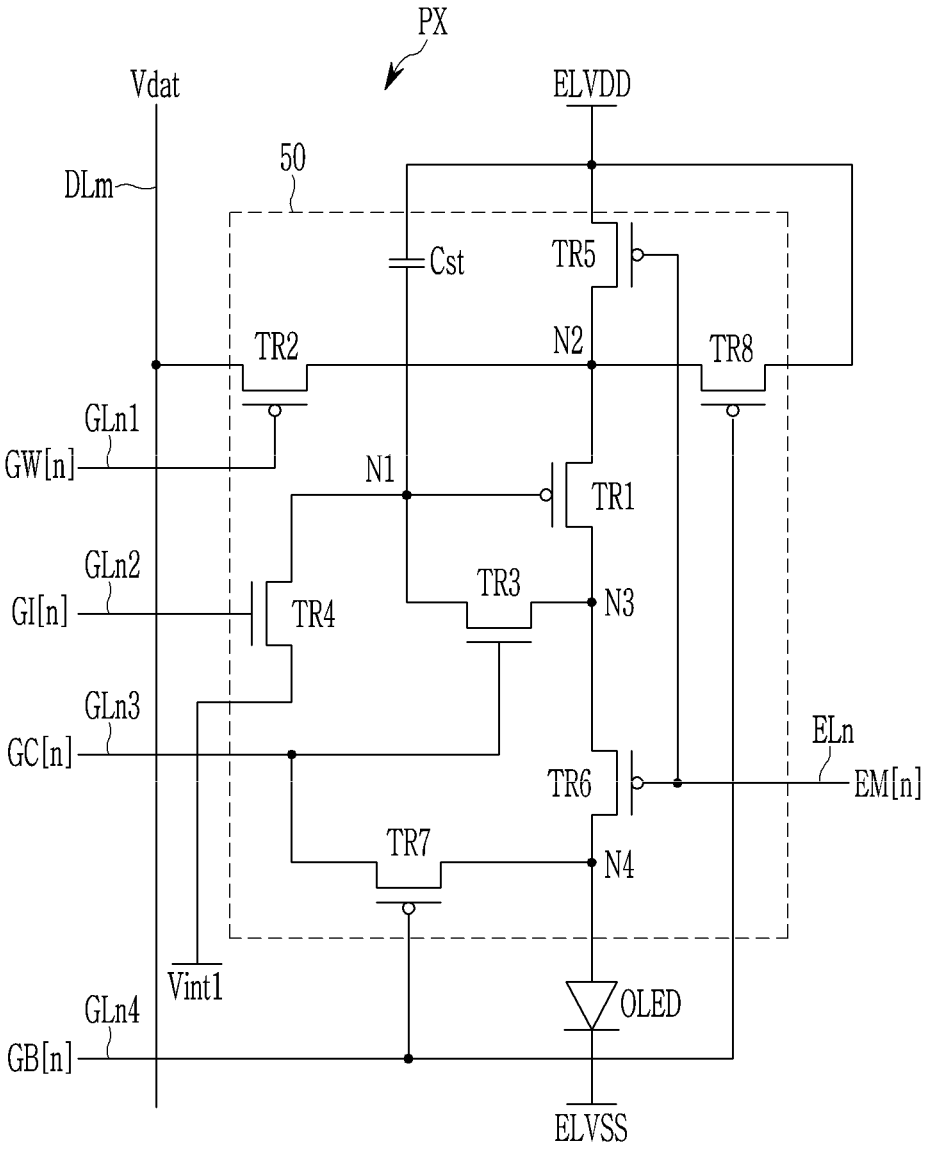
FIG. 7 is a circuit diagram of a pixel circuit according to one or more embodiments of the present disclosure.

FIG. 7 is a circuit diagram of a pixel circuit according to one or more embodiments of the present disclosure.

Referring to FIG. 7, a fourth transistor TR4 included in a pixel circuit 50 according to one or more embodiments includes a gate electrode connected with a second gate line GLn2, a first electrode connected with a power line to which a first initialization voltage Vint1 is applied, and a second electrode connected with a first node N1. The fourth transistor TR4 is connected between the power line to which the first initialization voltage Vint1 is applied and the first node N1.

The fourth transistor TR4 is turned on by a second gate signal GI[n] of a high level voltage e.g., the gate-on voltage) during an initialization period P2, and thus transmits the first initialization voltage Vint1 to the first node N1. A gate voltage of the first transistor TR1 is initialized to the first initialization voltage Vint1.

A seventh transistor TR7 included in the pixel circuit 50 according to the present embodiment includes a gate electrode connected with a fourth gate line GLn4, a first electrode connected with a third gate line GLn3, and a second electrode connected with a fourth node N4. The seventh transistor TR7 is connected between the third gate line GLn3 and an anode of an organic light emitting diode OLED.

The seventh transistor TR7 is turned on by a fourth gate signal GB[n] of a low level voltage (e.g., the gate-on voltage) during a reset period P1, and thus transmits a third gate signal GC[n] of a low level voltage to the fourth node N4. An anode voltage of the organic light emitting diode OLED is reset to the low level voltage of the third gate signal GC[n].

An eighth transistor TR8 included in the pixel circuit 50 according to the present embodiment includes a gate electrode connected with the fourth gate line GLn4, a first electrode connected with a power line to which a first power voltage ELVDD is applied, and a second electrode connected with a second node N2. The eighth transistor TR8 is connected between the power line to which the first power voltage ELVDD is applied and the second node N2.

The eighth transistor TR8 is turned on by the fourth gate signal GB[n] of the low level voltage (e.g., the gate-on voltage) during the reset period P1, and thus transmits the first power voltage ELVDD to the second node N2.

A pixel PX according to the embodiment of FIG. 7 may not need a second initialization voltage Vint2 and a reference voltage VEH, and thus a power line for the second initialization voltage Vint2 and a power line for the reference voltage VEH may be omitted in a display portion 600, and a converter for generation of the second initialization voltage Vint2 and a converter for generation of the reference voltage VEH may be omitted in a power supply 500.

Except for such a difference, the features of the embodiment described with reference to FIG. 2 and FIG. 3 are applicable to the embodiment described with reference to FIG. 7, and thus the duplicated features of the embodiment described with reference to FIG. 2 and FIG. 3 may not be repeated.

Figure 8:
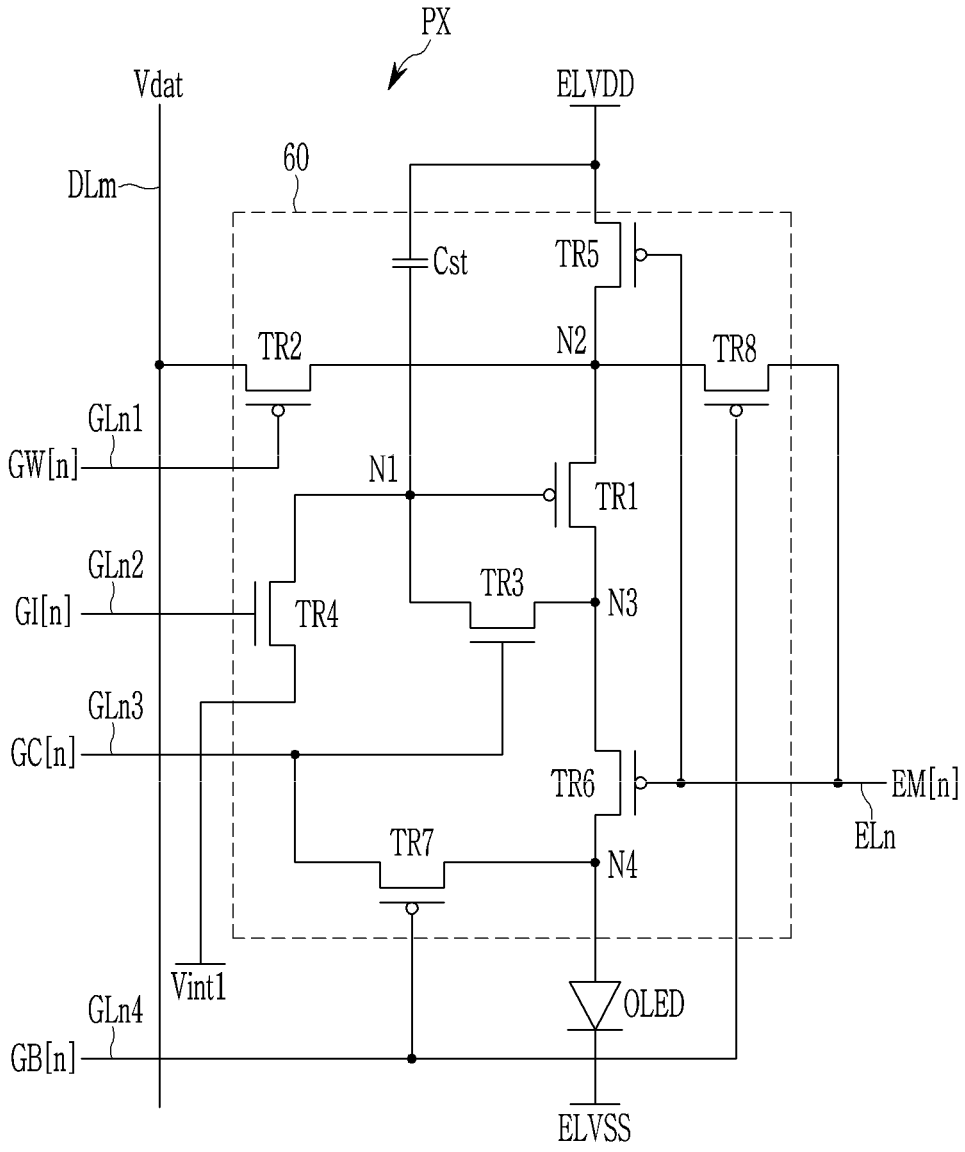
FIG. 8 is a circuit diagram of a pixel circuit according to one or more embodiments of the present disclosure.

FIG. 8 is a circuit diagram of a pixel circuit according to one or more embodiments of the present disclosure.

Referring to FIG. 8, a fourth transistor TR4 included in a pixel circuit 60 according to one or more embodiments includes a gate electrode connected with a second gate line GLn2, a first electrode connected with a power line to which a first initialization voltage Vint1 is applied, and a second electrode connected with a first node N1. The fourth transistor TR4 is connected between the power line to which the first initialization voltage Vint1 is applied and the first node N1.

The fourth transistor TR4 is turned on by a second gate signal GI[n] of a high level voltage (e.g., the gate-on voltage) during an initialization period P2, and thus transmits the first initialization voltage Vint1 to the first node N1. A gate voltage of the first transistor TR1 is initialized to the first initialization voltage Vint1.

A seventh transistor TR7 included in the pixel circuit 60 according to the present embodiment includes a gate electrode connected with a fourth gate line GLn4, a first electrode connected with a third gate line GLn3, and a second electrode connected with a fourth node N4. The seventh transistor TR7 is connected between the third gate line GLn3 and an anode of an organic light emitting diode OLED.

The seventh transistor TR7 is turned on by a fourth gate signal GB[n] of a low level voltage (e.g., the gate-on voltage) during a reset period P1, and thus transmits a third gate signal GC[n] of a low level voltage to the fourth node N4. An anode voltage of the organic light emitting diode OLED is reset to the low level voltage of the third gate signal GC[n].

An eighth transistor TR8 included in the pixel circuit 60 according to the present embodiment includes a gate electrode connected with the fourth gate line GLn4, a first electrode connected with a light emission control line ELn, and a second electrode connected with a second node N2. The eighth transistor TR8 is connected between the light emission control line ELn and the second node N2.

The eighth transistor TR8 is turned on by the fourth gate signal GB[n] of the low level voltage (e.g., the gate-on voltage) during the reset period P1, and thus transmits a light emission signal EM[n] of a high level voltage to the second node N2.

A pixel PX according to the embodiment of FIG. 8 may not need a second initialization voltage Vint2 and a reference voltage VEH, and thus a power line for the second initialization voltage Vint2 and a power line for the reference voltage VEH may be omitted in a display portion 600, and a converter for generation of the second initialization voltage Vint2 and a converter for generation of the reference voltage VEH may be omitted in a power supply 500.

Except for such a difference, the features of the embodiment described with reference to FIG. 2 and FIG. 3 are applicable to the embodiment described with reference to FIG. 8, and thus the duplicated features of the embodiment described with reference to FIG. 2 and FIG. 3 may not be repeated.

Figure 9:
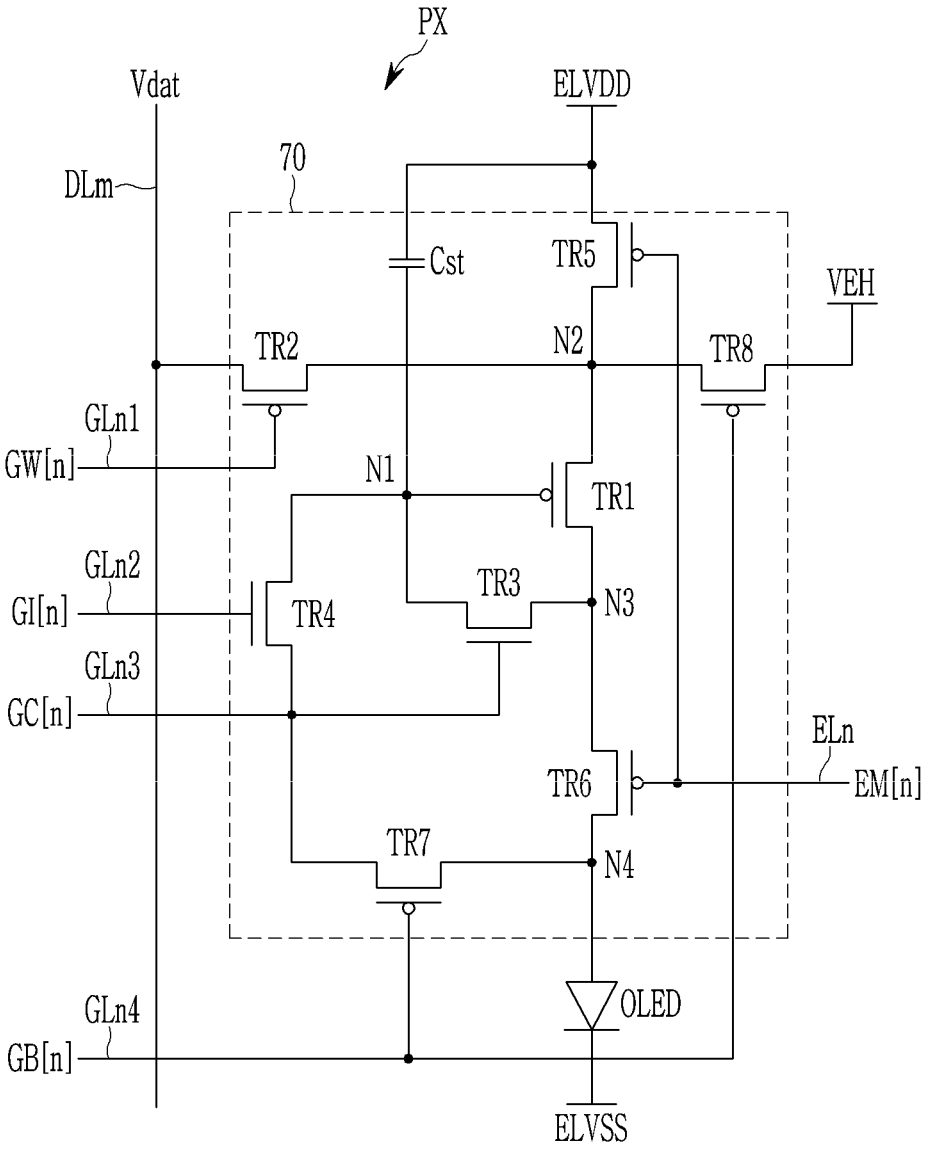
FIG. 9 is a circuit diagram of a pixel circuit according to one or more embodiments of the present disclosure.

FIG. 9 is a circuit diagram of a pixel circuit according to one or more embodiments of the present disclosure.

Referring to FIG. 9, a seventh transistor TR7 included in a pixel circuit 70 according to one or more embodiments includes a gate electrode connected with a fourth gate line GLn4, a first electrode connected with a third gate line GLn3, and a second electrode connected with a fourth node N4. The seventh transistor TR7 is connected between the third gate line GLn3 and an anode of an organic light emitting diode OLED.

The seventh transistor TR7 is turned on by a fourth gate signal GB[n] of a low level voltage (e.g., the gate-on voltage) during the reset period P1, and thus transmits a third gate signal GC[n] of a low level voltage to the fourth node N4. An anode voltage of the organic light emitting diode OLED is reset to the low level voltage of the third gate signal GC[n].

A pixel PX according to the embodiment of FIG. 9 may not need a first initialization voltage Vint1 and a second initialization voltage Vint2, and thus a power line for the first initialization voltage Vint1 and a power line for the second initialization voltage Vint2 may be omitted in a display portion 600, and a converter for generation of the first initialization voltage Vint1 and a converter for generation of the second initialization voltage Vint2 may be omitted in a power supply 500.

Except for such a difference, the features of the embodiment described with reference to FIG. 2 and FIG. 3 are applicable to the embodiment described with reference to FIG. 9, and thus the duplicated features of the embodiment described with reference to FIG. 2 and FIG. 3 may not be repeated.

Figure 10:
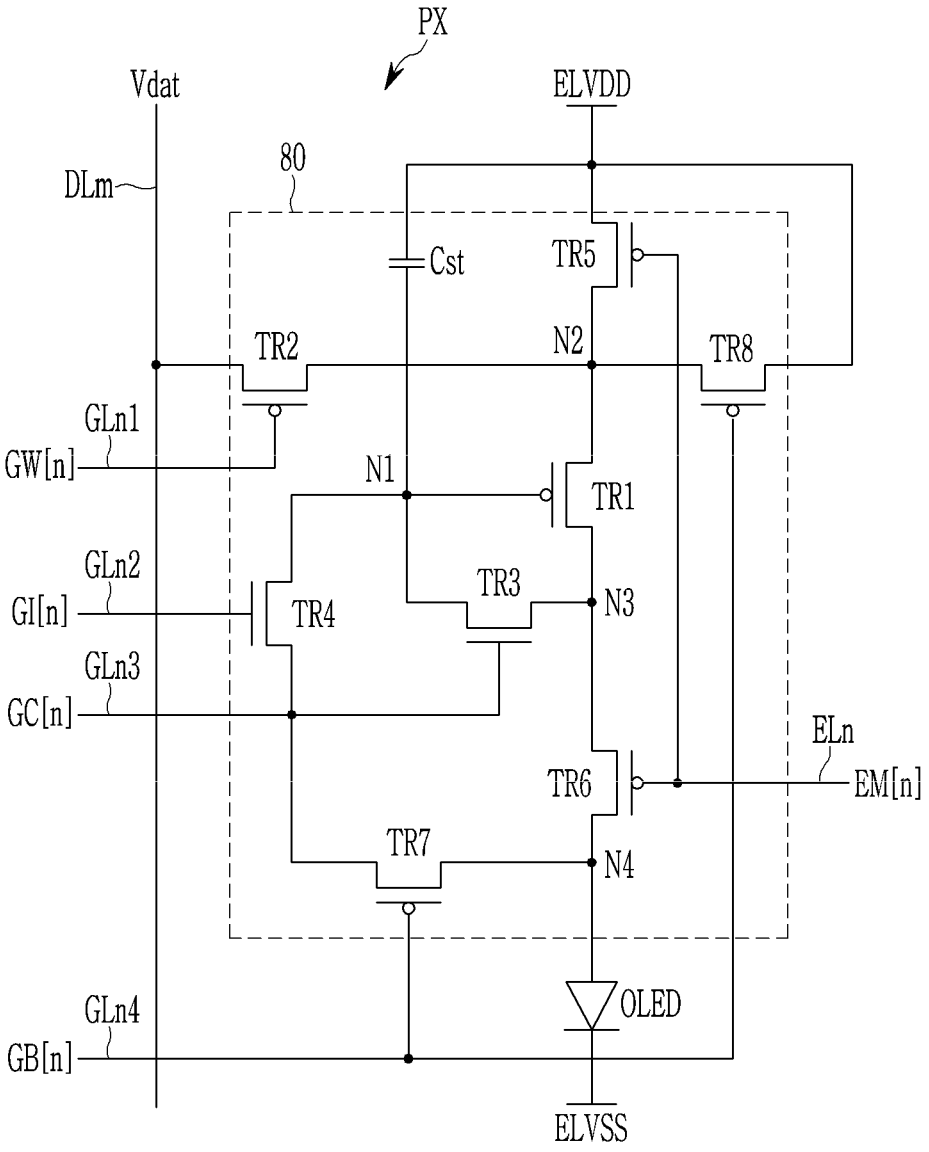
FIG. 10 is a circuit diagram of a pixel circuit according to one or more embodiments of the present disclosure.

FIG. 10 is a circuit diagram of a pixel circuit according to one or more embodiments of the present disclosure.

Referring to FIG. 10, a seventh transistor TR7 included in a pixel circuit 80 according to one or more embodiments includes a gate electrode connected with a fourth gate line GLn4, a first electrode connected with a third gate line GLn3, and a second electrode connected with a fourth node N4. The seventh transistor TR7 is connected between the third gate line GLn3 and an anode of an organic light emitting diode OLED.

The seventh transistor TR7 is turned on by a fourth gate signal GB[n] of a low level voltage (e.g., the gate-on voltage) during a reset period P1, and thus transmits a third gate signal GC[n] of a low level voltage (e.g., the gate-off voltage) to the fourth node N4. An anode voltage of the organic light emitting diode OLED is reset to the low level voltage of the third gate signal GC[n].

An eighth transistor TR8 included in the pixel circuit 50 according to the present embodiment includes a gate electrode connected with the fourth gate line GLn4, a first electrode connected with a power line to which a first power voltage ELVDD is applied, and a second electrode connected with a second node N2. The eighth transistor TR8 is connected between the power line to which the first power voltage ELVDD is applied and the second node N2.

The eighth transistor TR8 is turned on by the fourth gate signal GB[n] of the low level voltage (e.g., the gate-on voltage) during the reset period P1, and thus transmits the first power voltage ELVDD to the second node N2.

A pixel PX according to the embodiment of FIG. 10 may not need a first initialization voltage Vint1, a second initialization voltage Vint2, and a reference voltage VEH. Accordingly, a power line for the first initialization voltage Vint1, a power line for the second initialization voltage Vint2, and a power line for the reference voltage VEH may be omitted in a display portion 600, and a converter for generation of the first initialization voltage Vint1, a converter for generation of the second initialization voltage Vint2, and a converter for generation of the reference voltage VEH may be omitted in a power supply 500.

Except for such a difference, the features of the embodiment described with reference to FIG. 2 and FIG. 3 are applicable to the embodiment described with reference to FIG. 10, and thus the duplicated features of the embodiment described with reference to FIG. 2 and FIG. 3 may not be repeated.

Figure 11:
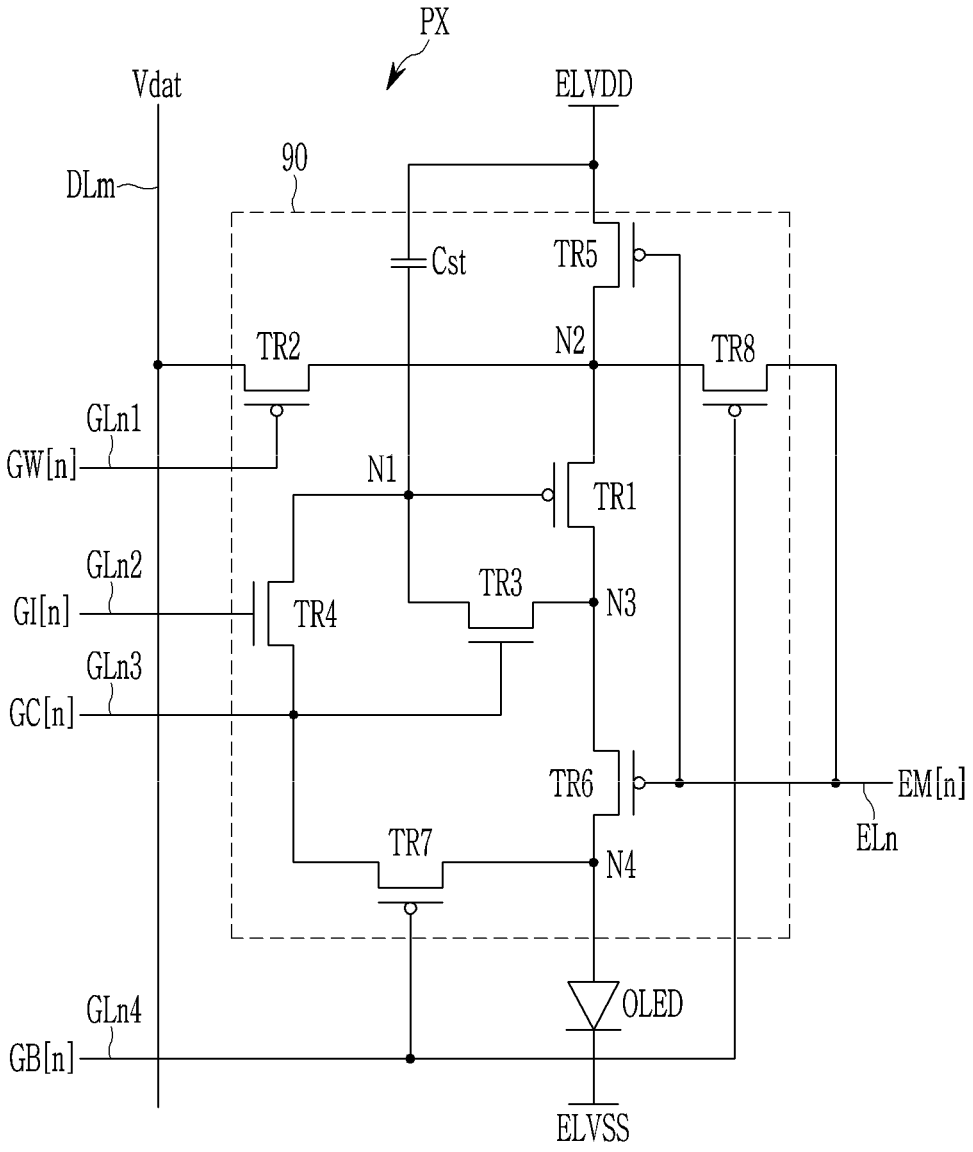
FIG. 11 is a circuit diagram of a pixel circuit according to one or more embodiments of the present disclosure.

FIG. 11 is a circuit diagram of a pixel circuit according to one or more embodiments of the present disclosure.

Referring to FIG. 11, a seventh transistor TR7 included in a pixel circuit 90 according to one or more embodiments includes a gate electrode connected with a fourth gate line GLn4, a first electrode connected with a third gate line GLn3, and a second electrode connected with a fourth node N4. The seventh transistor TR7 is connected between the third gate line GLn3 and an anode of an organic light emitting diode OLED.

The seventh transistor TR7 is turned on by a fourth gate signal GB[n] of a low level voltage (e.g., the gate-on voltage) during a reset period P1, and thus transmits a third gate signal GC[n] of a low level voltage to the fourth node N4. An anode voltage of the organic light emitting diode OLED is reset to the low level voltage of the third gate signal GC[n].

An eighth transistor TR8 included in the pixel circuit 90 according to the present embodiment includes a gate electrode connected with the fourth gate line GLn4, a first electrode connected with a light emission control line ELn, and a second electrode connected with a second node N2. The eighth transistor TR8 is connected between the light emission control line ELn and the second node N2.

The eighth transistor TR8 is turned on by the fourth gate signal GB[n] of the low level voltage (e.g., the gate-on voltage) during the reset period P1, and thus transmits a light emission signal EM[n] of a high level voltage to the second node N2.

A pixel PX according to the embodiment of FIG. 11 may not need a first initialization voltage Vint1, a second initialization voltage Vint2, and a reference voltage VEH. Accordingly, a power line for the first initialization voltage Vint1, a power line for the second initialization voltage Vint2, and a power line for the reference voltage VEH may be omitted in a display portion 600, and a converter for generation of the first initialization voltage Vint1, a converter for generation of the second initialization voltage Vint2, and a converter for generation of the reference voltage VEH may be omitted in a power supply 500.

Except for such a difference, the features of the embodiment described with reference to FIG. 2 and FIG. 3 are applicable to the embodiment described with reference to FIG. 11, and thus the duplicated features of the embodiment described with reference to FIG. 2 and FIG. 3 may not be repeated.

Figure 12:
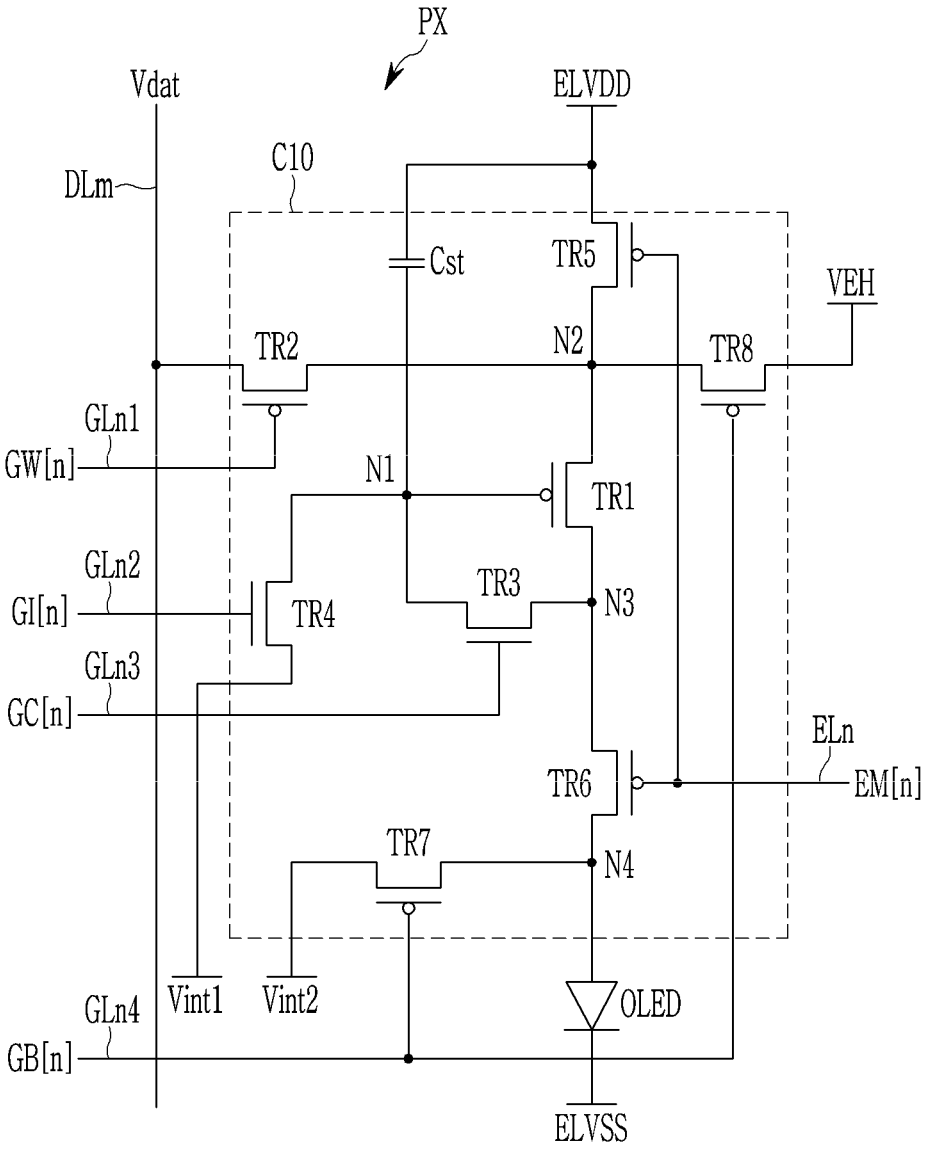
FIG. 12 is a circuit diagram of a pixel circuit according to one or more comparative embodiments of the present disclosure.

FIG. 12 is a circuit diagram of a pixel circuit according to one or more comparative embodiments of the present disclosure.

Referring to FIG. 12, a fourth transistor TR4 included in a pixel circuit C10 according to a comparative example includes a gate electrode connected with a second gate line GLn2, a first electrode connected with a power line to which a first initialization voltage Vint1 is applied, and a second electrode connected with a first node N1. The fourth transistor TR4 is connected between the power line to which the first initialization voltage Vint1 is applied and the first node N1.

The fourth transistor TR4 is turned on by a second gate signal GI[n] of a high level voltage (e.g., the gate-on voltage) during an initialization period P2, and thus transmits the first initialization voltage Vint1 to the first node N1. A gate voltage of the first transistor TR1 is initialized to the first initialization voltage Vint1.

A pixel PX of the comparative example of FIG. 12 may require a first initialization voltage Vint1, a second initialization voltage Vint2, and a reference voltage VEH. Accordingly, a power line for the first initialization voltage Vint and a power line for the second initialization voltage Vint2 may be aligned in a display portion 600, and a power supply 500 may include a converter for generation of the first initialization voltage Vint1, a converter for generation of the second initialization voltage Vint2, and a converter for generation of the reference voltage VEH.

Compared to the pixel PX of the comparative example of FIG. 12, the pixels PX of FIG. 2 and FIGS. 4-11 may not require at least one of the first initialization voltage Vint1, the second initialization voltage Vint2, and/or the reference voltage VEH, and thus the number of power lines aligned in the display portion 600 may be reduced, and the number of converters included in the power supply 500 may be reduced as well. Accordingly, a high resolution display device having a larger number of pixels in a relatively limited space may be manufactured, the structure of the display device may be simplified, and the manufacturing cost of the display device may be lowered.

While this disclosure has been described in connection with what is presently considered to be practical embodiments, it is to be understood that the disclosure is not limited to the disclosed embodiments. On the contrary, it is intended to cover various modifications and equivalent arrangements included within the spirit and scope of the appended claims. It will be understood by those skilled in the art that various changes in form and detail may be made without departing from the scope of the present disclosure. Accordingly, the true scope of the present disclosure should be determined by the technical idea of the appended claims, with functional equivalents thereof to be included therein.

What is claimed is:

1. A display device comprising a plurality of pixels, a pixel of the plurality of pixels comprising an organic light emitting diode, and a pixel circuit to control a current flowing to the organic light emitting diode, wherein the pixel circuit comprises:

a first transistor comprising a gate electrode connected with a first node, a first electrode connected with a second node, and a second electrode connected with a third node;

a second transistor comprising a gate electrode connected with a first gate line, a first electrode connected with a data line, and a second electrode connected with the second node;

a third transistor comprising a gate electrode connected with a third gate line, a first electrode connected with the third node, and a second electrode connected with the first node; and a fourth transistor comprising a gate electrode connected with a second gate line, a first electrode connected with the third gate line, and a second electrode connected with the first node.

2. The display device of claim 1, wherein the fourth transistor is to transmit a third gate signal of a gate-off voltage applied to the third gate line to the first node, and is to initialize a gate voltage of the first transistor.

3. The display device of claim 1, wherein the first transistor and the second transistor are polycrystalline transistors comprising a polycrystalline semiconductor, and the third transistor and the fourth transistor are oxide transistors comprising an oxide semiconductor.

4. The display device of claim 3, wherein the first transistor and the second transistor are p-type transistors to be turned on by a low level voltage, and the third transistor and the fourth transistor are n-type transistors to be turned on by a high level voltage.

5. The display device of claim 1, wherein the pixel circuit further comprises:

a fifth transistor comprising a gate electrode connected with a light emission control line, a first electrode connected with a power line to which a first power voltage is applied, and a second electrode connected with the second node;

a sixth transistor comprising a gate electrode connected with the light emission control line, a first electrode connected with the third node, and a second electrode connected with a fourth node; and a seventh transistor comprising a gate electrode connected with a fourth gate line, a first electrode connected with a power line to which an initialization voltage is applied, and a second electrode connected with the fourth node, wherein an anode of the organic light emitting diode is connected with the fourth node.

6. The display device of claim 5, wherein the pixel circuit further comprises an eighth transistor comprising a gate electrode connected with the fourth gate line, a first electrode connected with a power line to which a reference voltage is applied, and a second electrode connected with the second node.

7. The display device of claim 6, wherein the reference voltage is higher than the first power voltage.

8. The display device of claim 5, wherein the pixel circuit further comprises an eighth transistor comprising a gate electrode connected with the fourth gate line, a first electrode connected with the power line to which the first power voltage is applied, and a second electrode connected with the second node.

9. The display device of claim 5, wherein the pixel circuit further comprises an eighth transistor comprising a gate electrode connected with the fourth gate line, a first electrode connected with the light emission control line, and a second electrode connected with the second node.

10. The display device of claim 1, wherein the pixel circuit further comprises:

a fifth transistor comprising a gate electrode connected with a light emission control line, a first electrode connected with a power line to which a first power voltage is applied, and a second electrode connected with the second node;

a sixth transistor comprising a gate electrode connected with the light emission control line, a first electrode connected with the third node, and a second electrode connected with a fourth node; and a seventh transistor comprising a gate electrode connected with a fourth gate line, a first electrode connected with the third gate line, and a second electrode connected with the fourth node, wherein an anode of the organic light emitting diode is connected with the fourth node.

11. The display device of claim 10, wherein the pixel circuit further comprises an eighth transistor comprising a gate electrode connected with the fourth gate line, a first electrode connected with a power line to which a reference voltage is applied, and a second electrode connected with the second node.

12. The display device of claim 10, wherein the pixel circuit further comprises an eighth transistor comprising a gate electrode connected with the fourth gate line, a first electrode connected with a power line to which the first power voltage is applied, and a second electrode connected with the second node.

13. The display device of claim 10, wherein the pixel circuit further comprises an eighth transistor comprising a gate electrode connected with the fourth gate line, a first electrode connected with the light emission control line, and a second electrode connected with the second node.

14. A display device comprising a plurality of pixels, a pixel of the plurality of pixels comprising an organic light emitting diode and a pixel circuit to control a current flowing to the organic light emitting diode, wherein the pixel circuit comprises:

a first transistor comprising a gate electrode connected with a first node, a first electrode connected with a second node, and a second electrode connected with a third node;

a second transistor comprising a gate electrode connected with a first gate line, a first electrode connected with a data line, and a second electrode connected with the second node;

a third transistor comprising a gate electrode connected with a third gate line, a first electrode connected with the third node, and a second electrode connected with the first node;

a fourth transistor comprising a gate electrode connected with a second gate line, a first electrode connected with a power line to which an initialization voltage is applied, and a second electrode connected with the first node; and a seventh transistor comprising a gate electrode connected with a fourth gate line, a first electrode connected with the third gate line, and a second electrode connected with a fourth node, wherein an anode of the organic light emitting diode is connected with the fourth node.

15. The display device of claim 14, wherein the seventh transistor is to transmit a third gate signal of a gate-off voltage applied to the third gate line to the fourth node, and to reset an anode voltage of the organic light emitting diode.

16. The display device of claim 14, wherein the pixel circuit further comprises an eighth transistor comprising a gate electrode connected with the fourth gate line, a first electrode connected with a power line to which a reference voltage is applied, and a second electrode connected with the second node.

17. The display device of claim 14, wherein the pixel circuit further comprises an eighth transistor comprising a gate electrode connected with the fourth gate line, a first electrode connected with a power line to which a first power voltage is applied, and a second electrode connected with the second node.

18. The display device of claim 14, wherein the pixel circuit further comprises:

a fifth transistor comprising a gate electrode connected with a light emission control line, a first electrode connected with a power line to which a first power voltage is applied, and a second electrode connected with the second node;

a sixth transistor comprising a gate electrode connected with the light emission control line, a first electrode connected with the third node, and a second electrode connected with the fourth node; and an eighth transistor comprising a gate electrode connected with the fourth gate line, a first electrode connected with the light emission control line, and a second electrode connected with the second node.

19. A method for driving a display device comprising a plurality of pixels, a pixel of the plurality of pixels comprising a pixel circuit to receive a first gate signal, a second gate signal, a third gate signal, a fourth gate signal, and a light emission signal, and to control a current flowing to an organic light emitting diode, the method comprising:

resetting an anode voltage of the organic light emitting diode as the fourth gate signal is applied as a gate-on voltage;

resetting a first transistor to control a current flowing to the organic light emitting diode from a first power voltage;

initializing a gate voltage of the first transistor to a gate-off voltage of the third gate signal as the second gate signal is applied as a gate-on voltage;

diode-coupling the first transistor as the first gate signal and the third gate signal are applied as a gate-on voltage;

writing a data voltage compensated from a threshold voltage of the first transistor as a gate voltage of the first transistor; and emitting light with brightness corresponding to a current flowing through the first transistor by the organic light emitting diode as the light emission signal is applied as a gate-on voltage.

20. The method for driving the display device of claim 19, further comprising resetting the first transistor to one of the first power voltage, a reference voltage that is higher than the first power voltage, or a high level voltage of the light emission signal as the fourth gate signal is applied as a gate-on voltage.

* * * * *